US008651170B2

(12) United States Patent
Maeda et al.

(10) Patent No.: US 8,651,170 B2
(45) Date of Patent: Feb. 18, 2014

(54) EXHAUST GAS HEAT EXCHANGER

(75) Inventors: Takahiro Maeda, Kariya (JP); Kimio Kohara, Nagoya (JP); Yasutoshi Yamanaka, Kariya (JP)

(73) Assignee: Denso Corporation, Kariya (JP)

( * ) Notice: Subject to any disclaimer, the term of this patent is extended or adjusted under 35 U.S.C. 154(b) by 545 days.

(21) Appl. No.: 12/583,667

(22) Filed: Aug. 24, 2009

(65) Prior Publication Data

US 2010/0044019 A1 Feb. 25, 2010

(30) Foreign Application Priority Data

Aug. 25, 2008 (JP) ..... 2008-215788

(51) Int. Cl.

| | |
|---|---|
| ***F28F 3/00*** | (2006.01) |
| ***F28D 7/02*** | (2006.01) |
| ***F28F 3/08*** | (2006.01) |
| ***F28D 1/02*** | (2006.01) |
| ***F28F 9/02*** | (2006.01) |

(52) U.S. Cl.

USPC ..... 165/166; 165/164; 165/165; 165/167; 165/152; 165/174

(58) Field of Classification Search

USPC ..... 165/164–167, 152, 158, 174, 181

See application file for complete search history.

(56) References Cited

U.S. PATENT DOCUMENTS

| | | | | |
|---|---|---|---|---|
| 4,561,494 | A | 12/1985 | Frost | |
| 5,413,872 | A * | 5/1995 | Faigle | 428/603 |
| 5,517,757 | A * | 5/1996 | Hayashi et al. | 29/890.039 |
| 5,979,542 | A * | 11/1999 | Inoue et al. | 165/133 |
| 6,460,613 | B2 * | 10/2002 | Nash et al. | 165/153 |
| 2002/0043361 | A1 * | 4/2002 | Saito et al. | 165/153 |
| 2003/0010479 | A1 | 1/2003 | Hayashi et al. | |
| 2006/0137867 | A1 | 6/2006 | Hayashi et al. | |
| 2006/0151149 | A1 * | 7/2006 | Haglid | 165/54 |
| 2006/0201660 | A1 * | 9/2006 | Watanabe | 165/157 |
| 2006/0207245 | A1 * | 9/2006 | Yamaguchi et al. | 60/320 |

(Continued)

FOREIGN PATENT DOCUMENTS

| | | | | |
|---|---|---|---|---|
| JP | 63267889 A | * 11/1988 | | F28D 9/00 |
| JP | Y2-6-45153 | 11/1994 | | |

(Continued)

OTHER PUBLICATIONS

Notice of Reason for Refusal mailed May 8, 2012 in a corresponding Japanese Application No. 2008-215788 with English translation thereof.

(Continued)

*Primary Examiner* — Frantz Jules
*Assistant Examiner* — Joseph Trpisovsky
(74) *Attorney, Agent, or Firm* — Harness, Dickey & Pierce, PLC

(57) ABSTRACT

Heat is exchanged between exhaust gas passing through a plurality of tubes and cooling water passing through a plurality of passages defined outside of the plurality of tubes layered with each other. A heat exchanger includes a temperature decreasing portion arranged in a predetermined area on an outer surface of the tube adjacent to an inlet side of exhaust gas. The temperature decreasing portion is configured to decrease a temperature of a thermal boundary layer of the outer surface of the tube relative to cooling water by increasing a heat transmitting ratio between the outer surface of the tube and cooling water.

1 Claim, 5 Drawing Sheets

(56) References Cited

U.S. PATENT DOCUMENTS

| | | | | |
|---|---|---|---|---|
| 2006/0219394 | A1* | 10/2006 | Martin et al. | 165/157 |
| 2007/0017661 | A1 | 1/2007 | Geskes et al. | |
| 2007/0084593 | A1* | 4/2007 | Besant et al. | 165/167 |
| 2007/0125527 | A1* | 6/2007 | Flik et al. | 165/140 |
| 2007/0193732 | A1 | 8/2007 | Oofune et al. | |
| 2008/0110595 | A1* | 5/2008 | Palanchon | 165/103 |
| 2008/0164014 | A1 | 7/2008 | Nakamura | |
| 2008/0169093 | A1* | 7/2008 | Ohfune et al. | 165/164 |

FOREIGN PATENT DOCUMENTS

| | | |
|---|---|---|
| JP | 11-294975 | 10/1999 |
| JP | 2000-234566 | 8/2000 |
| JP | 2001-296097 | 10/2001 |
| JP | 2001-304787 | 10/2001 |
| JP | 2002-213888 | 7/2002 |
| JP | 2003-090693 | 3/2003 |
| JP | 2004-077024 | 3/2004 |
| JP | 2006-207887 | 8/2006 |
| JP | 2007-154683 | 6/2007 |
| JP | 2007-225190 | 9/2007 |
| JP | 2007-232330 | 9/2007 |
| JP | 2007-232355 | 9/2007 |
| JP | 2007-315325 | 12/2007 |
| JP | 2008-128611 | 6/2008 |
| JP | 2008-145024 | 6/2008 |

OTHER PUBLICATIONS

Office Action mailed Jul. 16, 2013 in the corresponding JP Application No. 2012-152564 which is divisional application of JP Application No. 2008-215788, with English translation thereof.

* cited by examiner

EXHAUST GAS HEAT EXCHANGER

CROSS REFERENCE TO RELATED APPLICATION

This application is based on Japanese Patent Application No. 2008-215788 filed on Aug. 25, 2008, the disclosure of which is incorporated herein by reference in its entirety.

BACKGROUND OF THE INVENTION

1. Field of the Invention

The present invention relates to a heat exchanger.

2. Description of Related Art

JP-A-2007-225190 discloses a heat exchanger to cool exhaust gas by using cooling water of an engine. Exhaust gas is discharged out of the engine, and a part of the exhaust gas is recirculated to an intake side of the engine by an exhaust gas recirculating device (EGR).

The heat exchanger includes plural flat heat-transmitting tubes, and an outer case having a rectangular cross-section in which the flat tubes are layered. Exhaust gas is introduced into the tubes through an inlet part located at a longitudinal end of the outer case, and exhaust gas is discharged out of the tubes through an outlet part located at the other longitudinal end of the outer case. A main part of the outer case is defined between the inlet part and the outlet part.

Each longitudinal end of the heat-transmitting tube has an enlarged part, and the enlarged parts are bonded to each other when the heat-transmitting tubes are layered. An outer periphery of the bonded enlarged parts is bonded to an inner end wall of the main part of the outer case.

The main part of the outer case has an inlet tube through which cooling water flows into the main part, and an outlet tube through which cooling water flows out of the main part.

Cooling water flows into the main part of the outer case through the inlet tube, and passes outside of the heat-transmitting tubes so as to flow out of the main part of the outer case through the outlet tube.

Exhaust gas is distributed into the heat-transmitting tubes after flowing through the inlet part, and the distributed exhaust gas are collected by the outlet part so as to be discharged after passing through the heat-transmitting tubes. At this time, the exhaust gas passing through the tubes is cooled by the cooling water passing outside of the tubes.

However, when exhaust gas having a temperature of 700-800° C. is cooled by cooling water having a temperature of 90-100° C., cooling water may be locally boiled by exhaust gas adjacent to the inlet part.

SUMMARY OF THE INVENTION

In view of the foregoing and other problems, it is an object of the present invention to provide a heat exchanger.

According to a first example of the present invention, a heat exchanger includes a plurality of tubes layered with each other, a plurality of passages defined outside of the layered tubes, and a temperature decreasing portion. The tube has a flat cross-section, and heat is exchanged between exhaust gas of an internal combustion engine passing through the plurality of tubes and cooling water of the internal combustion engine passing through the plurality of passages. The temperature decreasing portion is arranged in a predetermined area on an outer surface of the tube adjacent to an inlet side of exhaust gas. The temperature decreasing portion is configured to decrease a temperature of a thermal boundary layer of the outer surface of the tube relative to cooling water by increasing a heat transmitting ratio between the outer surface of the tube and cooling water.

Accordingly, local boiling of cooling water can be restricted.

According to a second example of the present invention, a heat exchanger includes a plurality of tubes layered with each other, a plurality of passages defined outside of the layered tubes, a first inlet member, a second inlet member, and an outlet member. The tube has a flat cross-section, and heat is exchanged between exhaust gas of an internal combustion engine passing through the tubes and cooling water of the internal combustion engine passing through the passages. The first inlet member communicates with an inlet side of the passage, and cooling water flows into the passage through the first inlet member. The second inlet member communicates with an inlet side of the passage, and cooling water flows into the passage through the second inlet member. The outlet member communicates with an outlet side of the passage, and cooling water flows out of the passage through the outlet member. The first inlet member is located adjacent to an inlet side of exhaust gas, and the second inlet member is located to oppose a flow of cooling water flowing toward the passage through the first inlet member.

Accordingly, local boiling of cooling water can be restricted.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF PREFERRED EMBODIMENT

First Embodiment

A gas cooler 100A is used in an exhaust gas recirculating (EGR) device of an internal combustion engine for a vehicle. The gas cooler 100A may correspond to a heat exchanger. The engine may be a diesel engine or a gasoline engine.

Figure 1:
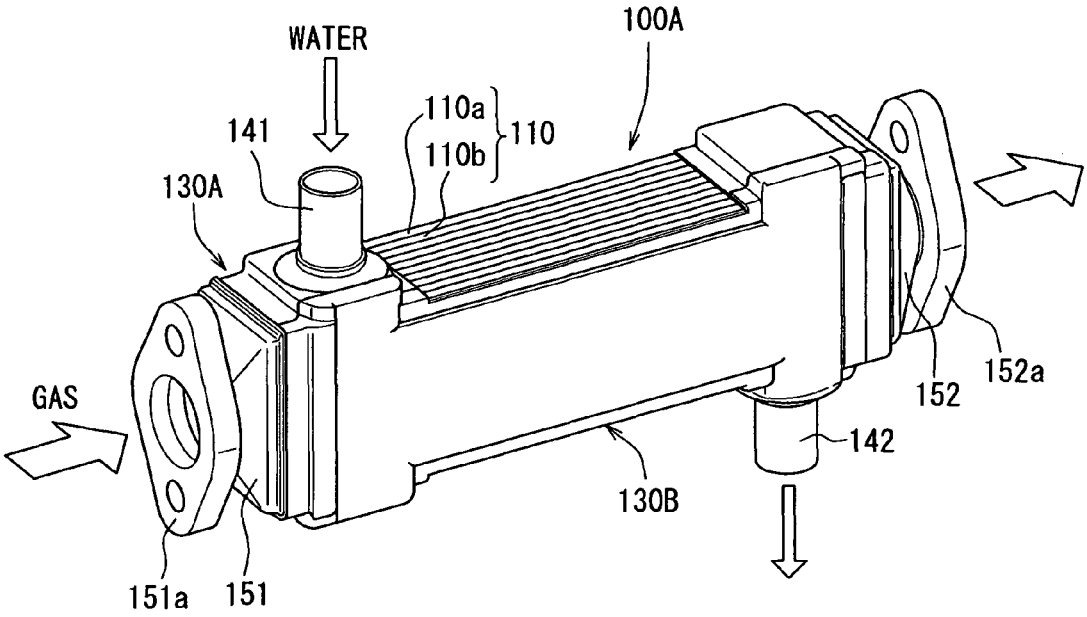
FIG. 1 is a perspective view illustrating a gas cooler according to a first embodiment.
Figure 3:
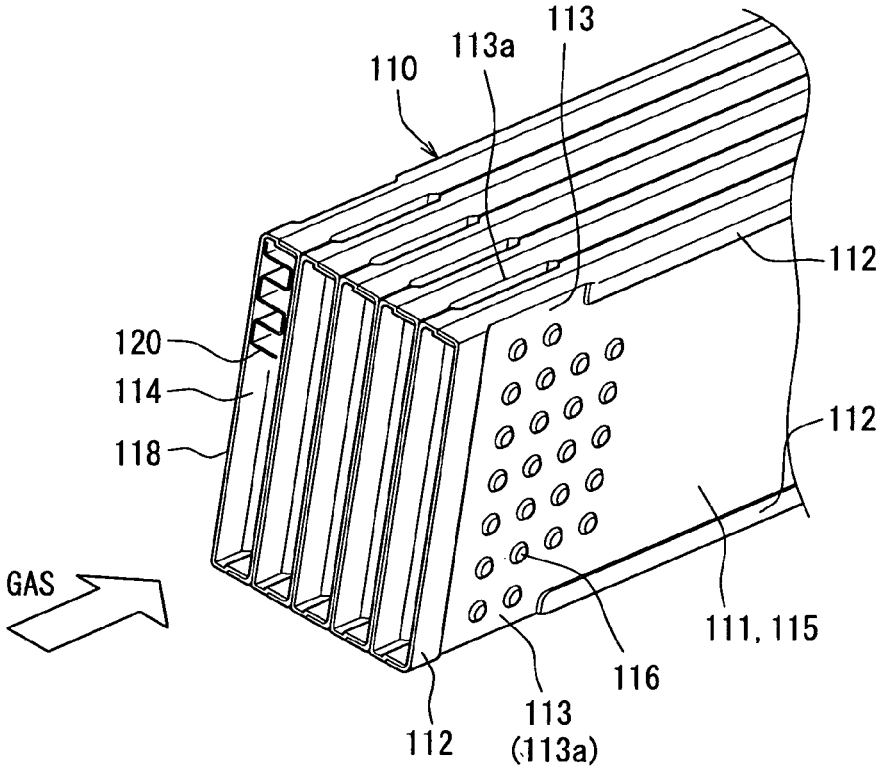
FIG. 3 is a schematic perspective view illustrating tubes of the gas cooler.

Due to the gas cooler 100A, exhaust gas to be recirculated to the engine is cooled by cooling water of the engine. As shown in FIG. 1, the gas cooler 100A includes plural tubes 110, a first water tank 130A, a second water tank 130B, a water inlet pipe 141, a water outlet pipe 142, a first gas tank 151, a second gas tank 152 and so on. As shown in FIG. 3, an inner fin 120 is disposed in the tube 110. The gas cooler 100A is made of a stainless steel material, for example, having strength and corrosion resistance, and is produced by brazing or welding.

As shown in FIG. 1, the tube 110 is constructed of a first plate 110*a* and a second plate 110*b*. The plate 110*a*, 110*b* having a shallow U-shape cross-section is produced by pressing or rolling a flat material. Open sides of the plates 110*a*, 110*b* are bonded to each other, such that the tube 110 has an elongate shape with a flat cross-section.

As shown in FIG. 3, the inner fin 120 is disposed in the tube 110, and the inner fin 120 has a wave-shaped cross-section produced by pressing a thin board material. The inner fin 120 is bonded to an inner face of the tube 110, and the inner face of the tube 110 corresponds to a tube base face 111 to be described below. The tube 110 having the inner fin 120 is produced by sandwiching the inner fin 120 between the plates 110*a*, 110*b*, and bonding the inner fin 120 and the plates 110*a*, 110*b*.

The tubes 110 are layered such that the tube base faces 111 oppose to each other. The tube base face 111 corresponds to a long side of the flat cross-section of the tube 110. A gas passage 114 is defined in the tube 110, and a water passage 115 is defined outside of the tube 110. The water passage 115 will be specifically described below.

The tube base face 111 has a projection part 112 and a recess part 113. The projection part 112 is an embossed part protruding outward from the tube base face 111 due to a pressing work. The projection part 112 is formed on an outer periphery of the tube base face 111 like a dam. The recess part 113 is recessed from a projecting top of the projection part 112 toward the tube base face 111. The recess part 113 may be a non-projection part in which the projection part 112 is not formed. The recess part 113 is positioned on four end portions of two long sides of the tube base face 111, for example.

The tubes 110 are layered such that the projection parts 112 formed on the tube base face 111 are contact and bonded with each other.

As shown in FIG. 3, the water passage 115 of cooling water is defined to be surrounded among the projection parts 112 between the layered tubes 110. An inlet side opening 113*a* is constructed with the recess parts 113 of the layered tubes 110, and cooling water flows from outside into the water passage 115 through the inlet side opening 113*a*. The inlet side opening 113*a* may be located at an upper part and a lower part of a longitudinal end portion of the tube 110, as shown in FIG. 3.

Figure 2:
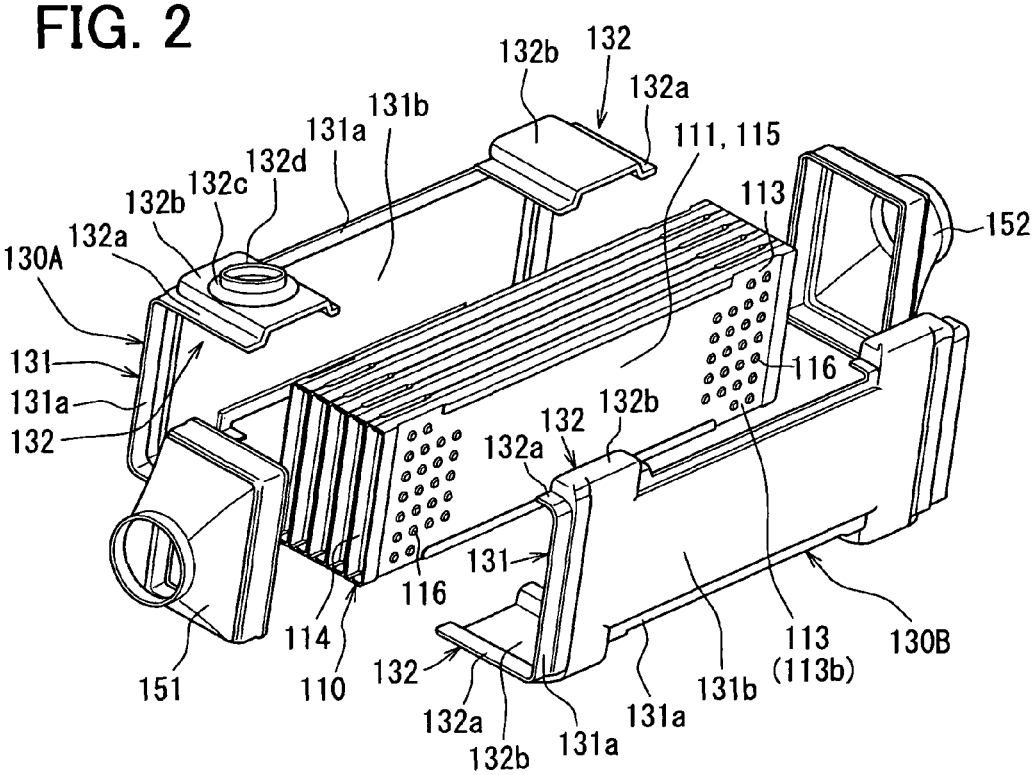
FIG. 2 is a schematic exploded perspective view illustrating the gas cooler.

As shown in FIG. 2, an outlet side opening 113*b* is constructed with the recess parts 113 of the layered tubes 110, and cooling water flows out of the water passage 115 through the outlet side opening 113*b*. The outlet side opening 113*b* may be located at an upper part and a lower part of the other longitudinal end portion of the tube 110. The inlet side opening 113*a* is located adjacent to an inlet side of the gas passage 114 of the tube 110, and the outlet side opening 113*b* is located adjacent to an outlet side of the gas passage 114 of the tube 110.

Plural projections 116 having protruding shape are defined on the tube base face 111 adjacent to the inlet side opening 113*a*. The projections 116 may correspond to a temperature decreasing portion to decrease a temperature of a thermal boundary layer of an outer surface of the tube 110 relative to cooling water. The projection 116 may be defined as a dimple recessed outward from an inner face of the tube 110.

As shown in FIG. 3, the projections 116 are located in a predetermined area extending from an inlet end 118 of the gas passage 114 toward a downstream side in the longitudinal direction of the tube 110. The predetermined area is defined to have an extending dimension of 30-80 mm, for example, from the inlet end 118 of the gas passage 114. The predetermined area may be defined to have the extending dimension of 40 mm from the inlet end 118 of the gas passage 114.

The projection 116 may have a cylinder shape, and may have a diameter of 4-6 mm, for example. The projections 116 have a grid-arrangement. A protruding dimension of the projection 116 is approximately equal to that of the projection part 112 located on the outer periphery of the tube 110. The location of the projections 116 is different between the plates 110*a*, 110*b*. The projection 116 of the plate 110*a* is positioned among the projections 116 of the plate 110*b*, when the tubes 110 are layered such that the plates 110*a*, 110*b* oppose to each other.

Due to the projections 116, volume of the water passage 115 in the predetermined area of the tube 110 becomes smaller than that of the water passage 115 in a normal area in which the projection 116 is not formed. A ratio of the volume of the predetermined area relative to that of the normal volume may be set equal to or smaller than 0.9 by changing size, number, or position of the projections 116.

Due to the projections 116, a contact area between the tube base face 111 and the inner fin 120 is decreased. A decreasing ratio of the contact area is equal to or larger than 5%, while the projections 116 are intentionally provided.

The projections 116 are further arranged in the other end portion of the tube 110 in the longitudinal direction adjacent to an outlet side of the gas passage 114, as shown in FIG. 2. That is, the projections 116 are symmetrically arranged relative to a center of the tube 110 in the longitudinal direction.

As shown in FIG. 2, the water tank 130A, 130B has a main portion 131 and a hanging portion 132. The main portion 131 opposes to the tube base face 111. The hanging portion 132 is formed by bending four corner parts of the main portion 131 toward the tube 110 by an angle of about 90° so as to cover the opening 113*a*, 113*b*. The water tanks 130A, 13B are assembled and bonded to each other so as to cover the layered tubes 110.

The main portion 131 has a periphery part 131*a*, and an expansion part 131*b*. The periphery part 131*a* contacts the projection part 112 of the tube 110. The expansion part 131*b* is located to be surrounded among the periphery parts 131*a*, and protrudes outward from the periphery part 131*a* in the layer direction of the tubes 110.

The hanging portion 132 has a periphery part 132*a* and an expansion part 132*b*. The periphery part 132*a* contacts side faces of the tubes 110 so as to cover the opening 113*a*, 113*b*. The expansion part 132*b* is located to be surrounded among the periphery parts 132*a*, and protrudes from the periphery part 132*a* in a width direction of the tube 110.

The water passage 115 is defined between the tube base face 111 of the tube 100 located most outside and the expansion part 131*b* of the main portion 131, similar to the water passage 115 defined between the tubes 110. The opening 113*a*, 113*b* is defined between the recess part 113 of the tube 100 located most outside and the expansion part 131*b* of the main portion 131, similar to the opening 113*a*, 113*b* defined between the tubes 110. Further, a space is defined between the side face of the tube 110 corresponding to the opening 113*a*, 113*b* and the expansion part 132*b* of the hanging portion 132.

An extending dimension of the hanging portion 132 is different between the tanks 130A, 130B. The extending dimension of the hanging portion 132 located on an upper side of the first water tank 130A of FIG. 2 is approximately equal to a layer dimension of the layered tubes 110. The hanging portion 132 located on an upper side of the second water tank 130B of FIG. 2 has a predetermined extending dimension sufficient for overlap with the hanging portion 132 located on the upper side of the first water tank 130A of FIG. 2. A relationship between an extending dimension of a lower side of the first water tank 130A of FIG. 2 and an extending dimension of a lower side of the second water tank 130B of FIG. 2 is opposite to the above relationship.

A bowl-shaped expansion 132*c* is defined in the expansion part 132*b* of the upper hanging portion 132 of the first water tank 130A so as to oppose the opening 113*a*. A pipe hole 132*d* is defined in the expansion 132*c* so as to be connected to the water inlet pipe 141, and a standing edge such as a burring is provided around the pipe hole 132*d*. Similarly, a bowl-shaped expansion (not shown) is defined in the expansion part of the lower hanging portion of the second water tank 130B so as to oppose the opening 113*b*. A pipe hole (not shown) is defined in the expansion so as to be connected to the water outlet pipe 142, and a standing edge such as a burring is provided around the pipe hole.

Cooling water flows from the engine into the water inlet pipe 141, and an end of the water inlet pipe 141 is inserted and connected to the pipe hole 132*d*. The water inlet pipe 141 communicates with the opening 113*a* of the tube 110 through the expansion 132*c* and the expansion part 132*b*.

Cooling water flows out of the water passage 115 of the tube 110 through the water outlet pipe 142, and an end of the water outlet pipe 142 is inserted and connected to the pipe hole of the second water tank 130B. The water outlet pipe 142 communicates with the opening 113*b* of the tube 110 through the expansion and the expansion part.

As shown in FIG. 2, the gas tank 151, 152 has a funnel shape. A relatively large opening of the funnel shape has a rectangle shape, and a relatively small opening of the funnel shape has a round shape. The rectangle opening of the tank 151, 152 contacts an outer periphery of the layered tubes 110 so as to be bonded. Inside of the tank 151, 152 communicates with the gas passages 114 of the layered tubes 110. As shown in FIG. 1, the round opening of the tank 151, 152 has a flange 151*a*, 152*a* to be connected to the exhaust gas recirculating device.

As shown in FIG. 1, a part of exhaust gas discharged from the engine flows into the gas cooler 100A through the flange 151 a and the gas tank 151. The exhaust gas passes through the gas passages 114 of the tubes 110, and is discharged out of the gas cooler 100A through the gas tank 152 and the flange 152*a*. The discharged gas is again taken into the engine.

Cooling water of the engine flows into the water passages 115 through the water inlet pipe 141, the hanging portion 132 and the opening 113*a*. The water passage 15 is located between the layered tubes 110, and is located between the tube 111 located most outside and the expansion part 131*b*. The cooling water is discharged out of the water passage 115 through the opening 113*b*, the hanging portion 132 and the water outlet pipe 142.

A part of cooling water flowing into the gas cooler 100A through the water inlet pipe 141 passes through the lower opening 113*a* shown in FIG. 3 and hits on the lower expansion part 132*b* of the second water tank 130B shown in FIG. 2. After the cooling water hits on the lower expansion part 132*b*, the cooling water performs a U-turn and passes through the water passage 115.

Heat is exchanged between exhaust gas passing through the gas passage 114 and cooling water passing through the water passage 115. Thus, the exhaust gas can be cooled by the cooling water.

According to the first embodiment, the projections 116 are arranged in a predetermined area of an outer surface of the tube 110 adjacent to an inlet side of exhaust gas. The projections 116 may correspond to a temperature decreasing portion. Due to the projections 116, heat transmitting ratio between the outer surface of the tube 110 and cooling water is raised, thereby a temperature of a thermal boundary layer of the outer surface of the tube 110 relative to the cooling water can be decreased.

Thus, the temperature of the outer surface of the tube 110 can be decreased. Accordingly, local boiling of cooling water adjacent to the inlet side of exhaust gas can be restricted.

Specifically, due to the projections 116, a cross-sectional area of the water passage 115 in the predetermined area of the tube 110 becomes smaller than that of the water passage 115 in a normal area in which the projection 116 is not formed. A ratio of the cross-sectional area of the predetermined area relative to that of the normal area may be equal to or smaller than 0.9 by changing size, number, or position of the projections 116.

Thus, a speed of cooling water adjacent to the inlet side of exhaust gas can be fast. Therefore, heat transmitting ratio between the outer surface of the tube 110 and the cooling water is raised, thereby the temperature of the thermal boundary layer of the outer surface of the tube 110 relative to the cooling water can be decreased. Accordingly, local boiling of cooling water adjacent to the inlet side of exhaust gas can be restricted.

Figure 4:
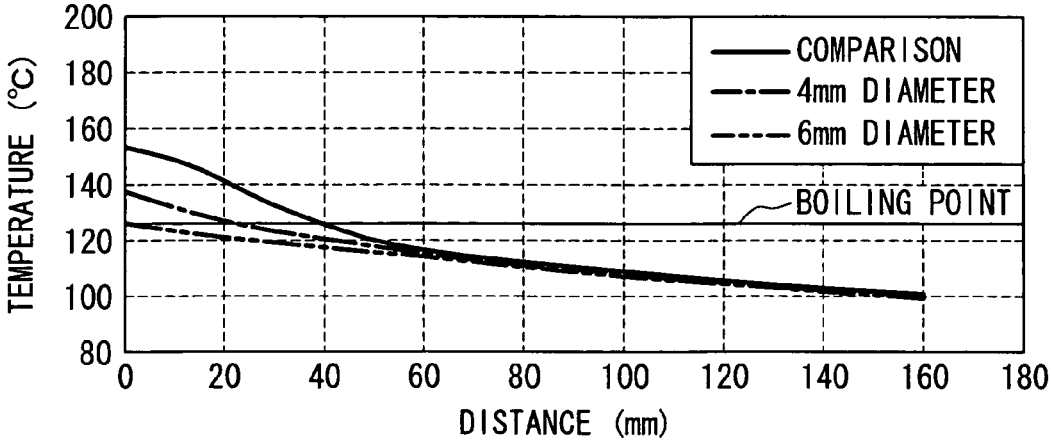
FIG. 4 is a graph illustrating a relationship between a distance and a temperature of results of experiments using the gas cooler.

FIG. 4 illustrates a graph indicating results of experiments to show effect of the restricting of the local boiling of cooling water due to the projections 116. The experiments are performed in a condition that exhaust gas has a temperature of 700° C., and a flowing amount of 12.5 g/s. Further, cooling water adjacent to the inlet side of exhaust gas has a temperature of 90° C., and a flowing amount of 12 L/min. Cooling water has a system pressure of 1.1 kPa.

The experiments are performed relative to a comparison example, a 4 mm diameter example, and a 6 mm diameter example. The comparison example represents a gas cooler not having the projections 116. The 4 mm diameter example represents the gas cooler 100A including the projections 116 having a diameter of 4 mm. The 6 mm diameter example represents the gas cooler 100A including the projections 116 having a diameter of 6 mm. The projections 116 are arranged in the predetermined area defined to have the extending dimension of 30 mm from the inlet end 118 of the tube 110 toward the downstream side.

Cooling water has a boiling point of about 127° C. shown in FIG. 4, in the condition that the cooling water has the system pressure of 1.1 kPa. A temperature of an outer surface of a tube of the comparison example not having the projections 116 is higher than the boiling point of cooling water, in an area having a distance of 0-40 mm from the inlet end 118, as shown in a solid line of FIG. 4.

In contrast, as shown in a chain line of FIG. 4, the temperature of 4 mm diameter example is higher than the boiling point of cooling water, in an area having a distance of 0-20 mm from the inlet end 118. Thus, the area having a temperature higher than the boiling point can be reduced. Further, a heat transmitting ratio $\alpha_w$ of cooling water of the 4 mm diameter example is increased by 1.15 times compared with the comparison example.

Further, a heat transmitting ratio $\alpha_w$ of cooling water of the 6 mm diameter example is increased by 1.3 times compared with the comparison example. As shown in a double chain line of FIG. 4, the outer surface of the tube 110 of the 6 mm diameter example has no area in which the temperature is higher than the boiling point.

The predetermined area in which the projections 116 are arranged is defined to have the extending dimension equal to or longer than 30 mm from the inlet end 118 of the tube 110. The extending dimension is defined to be equal to or shorter than 80 mm, so as to restrict a flowing resistance of cooling water from increasing. The predetermined area may be defined to have the extending dimension of 40 mm so as to restrict local boiling of cooling water.

The projections 116 are arranged in the other end portion of the tube 110 in the longitudinal direction adjacent to an outlet side of the gas passage 114, such that the projections 116 are symmetrically arranged relative to a center of the tube 110 in the longitudinal direction. Therefore, the tube 110 is directionless in the longitudinal direction, such that erroneous assembling can be restricted.

Second Embodiment

Figure 5:
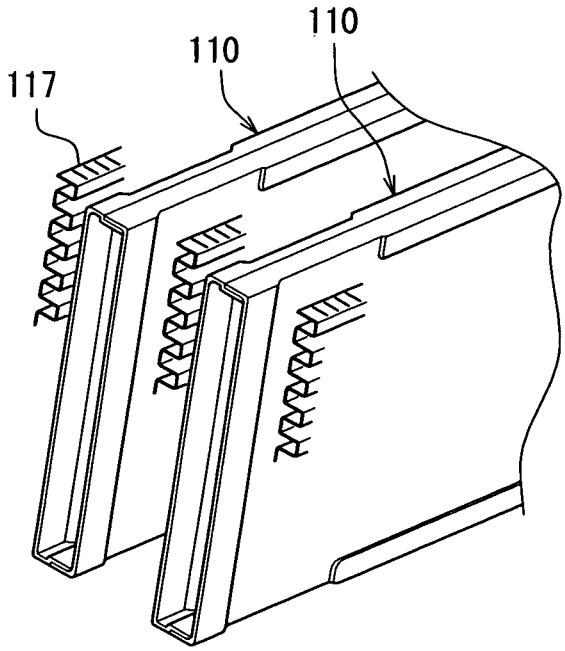
FIG. 5 is a schematic exploded perspective view illustrating outer fins of a gas cooler according to a second embodiment.

The projection 116 of the first embodiment is changed to an outer fin 117 in a second embodiment, as shown in FIG. 5. The outer fin 117 may correspond to a temperature decreasing portion.

The outer fin 117 has a wave-shaped cross-section produced by using a thin board material. The outer fin 117 may be corrugated fin having louver, or offset fin in which the wave-shaped cross-section has a staggered arrangement.

The outer fin 117 is arranged in a predetermined area between the layered tubes 110. Further, the outer fin 117 is arranged in a predetermined area between a tube 110 located most outside and an expansion part 131*b* of a water tank 130A, 130B.

Therefore, turbulent flow can be produced relative to cooling water, and a heat transmitting ratio can be improved. Thus, a temperature of a thermal boundary layer of an outer surface of the tube 110 relative to cooling water can be decreased. Accordingly, local boiling of cooling water adjacent to an inlet side of exhaust gas can be restricted.

Third Embodiment

Figure 6:
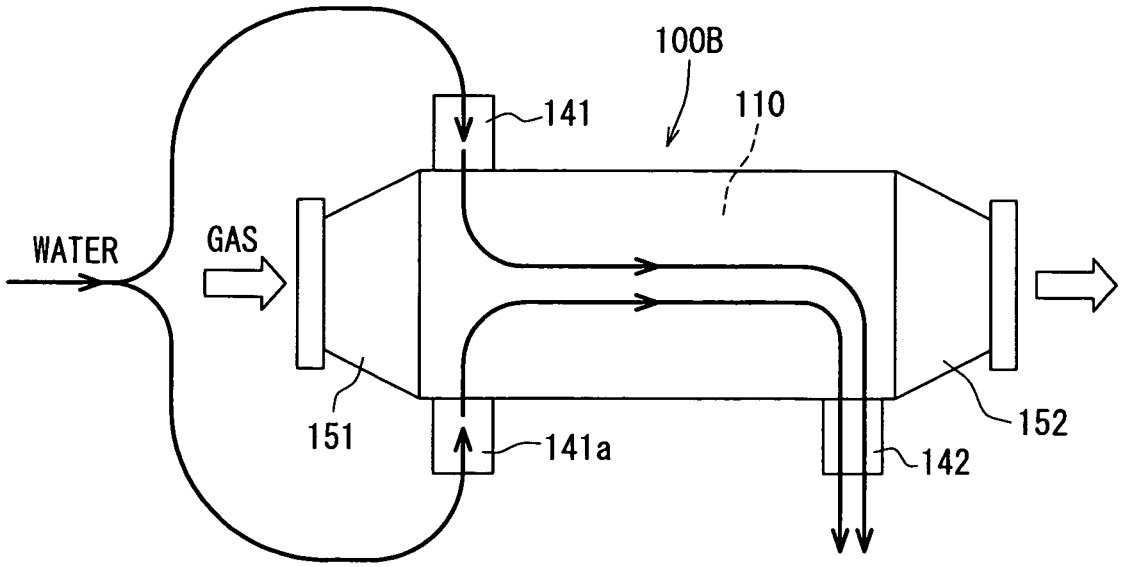
FIG. 6 is a schematic view illustrating a gas cooler according to a third embodiment.

A gas cooler 100B according to a third embodiment does not have the temperature decreasing portion such as the projection 116 of the first embodiment or the outer fin 117 of the second embodiment. As shown in FIG. 6, the gas cooler 100B includes a second water inlet pipe 141*a* in addition to a first water inlet pipe 141.

The second water inlet pipe 141*a* opposes to the first water inlet pipe 141 in a flowing direction of cooling water to flow into water passages 115 of tubes 110. As shown in FIG. 6, the first water inlet pipe 141 is located on an upper side of the tube 110, and the second water inlet pipe 141*a* is located on a lower side of the tube 110. The second water inlet pipe 141*a* communicates with an opening 113*a* located on the lower side of the tube 110.

A path of cooling water extending from the engine is branched into two paths. One of the paths is connected to the first water inlet pipe 141, and the other path is connected to the second water inlet pipe 141*a*. Thus, as shown in FIG. 6, cooling water separated in advance flows into the gas cooler 100B through both of the pipes 141, 141*a*. That is, cooling water flows into the gas cooler 100B through both of an upper part and a lower part of an inlet side of exhaust gas. Cooling water flowing into the water passage 115 through both of the pipes 141, 141*a* flows out of the gas cooler 100B through a water outlet pipe 142.

Therefore, cooling water can smoothly flow in the inlet side of exhaust gas. Thus, a temperature of a thermal boundary layer of an outer surface of the tube 110 relative to cooling water can be decreased. Accordingly, local boiling of cooling water adjacent to the inlet side of exhaust gas can be restricted.

Fourth Embodiment

In the first embodiment, the projection part 112 is formed on the outer periphery of the tube base face 111 like a dam. In a fourth embodiment, a projection part 212 of a tube base face 211 is formed only on end portions of a tube 210 in a longitudinal direction. That is, the tube base face 211 does not have a projection part extending in the longitudinal direction of the tube 210. Plural projections 116 and plural ribs 220 are formed on the tube base face 211 adjacent to an inlet side of exhaust gas. Constructions similar to the first embodiment have the same reference number, and a specific description of the similar constructions is omitted.

Figure 7:
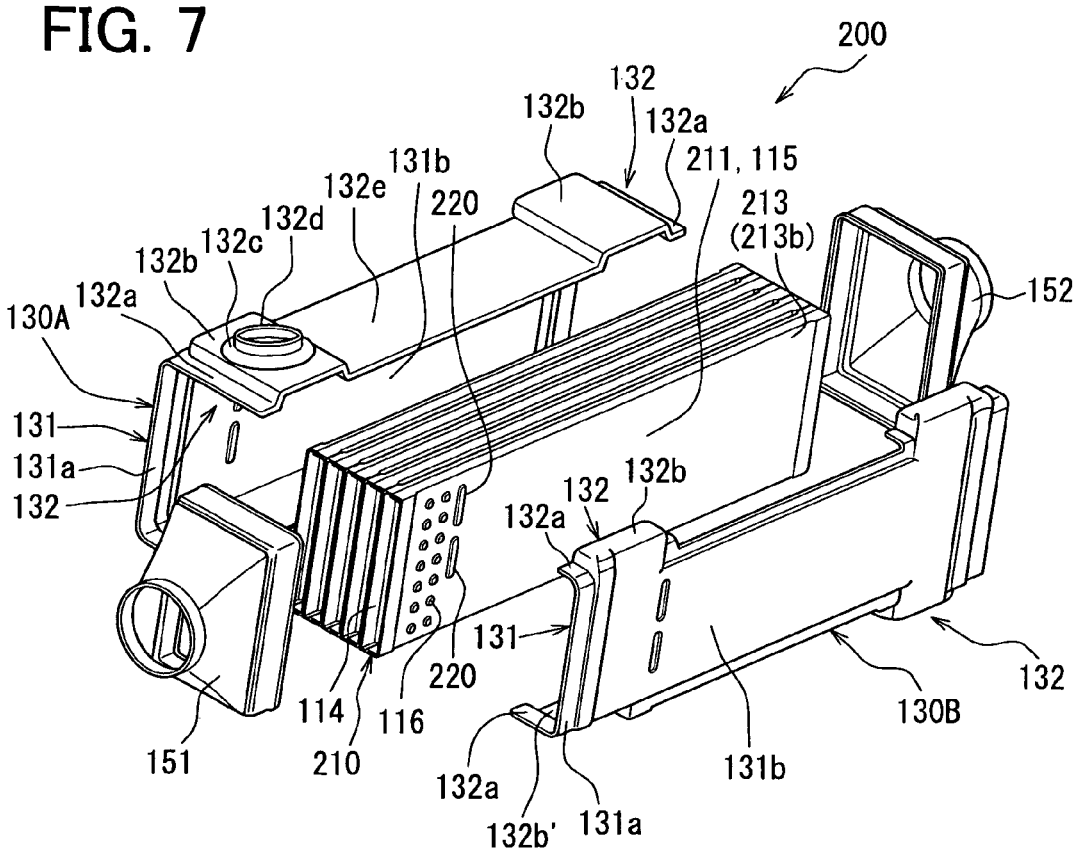
FIG. 7 is a schematic exploded perspective view illustrating a gas cooler according to a fourth embodiment.

As shown in FIG. 7, a gas cooler 200 includes plural tubes 210, a first water tank 130A, a second water tank 130B, a water inlet pipe 141, a water outlet pipe 142, a first gas tank 151, a second gas tank 152 and so on.

Figure 8:
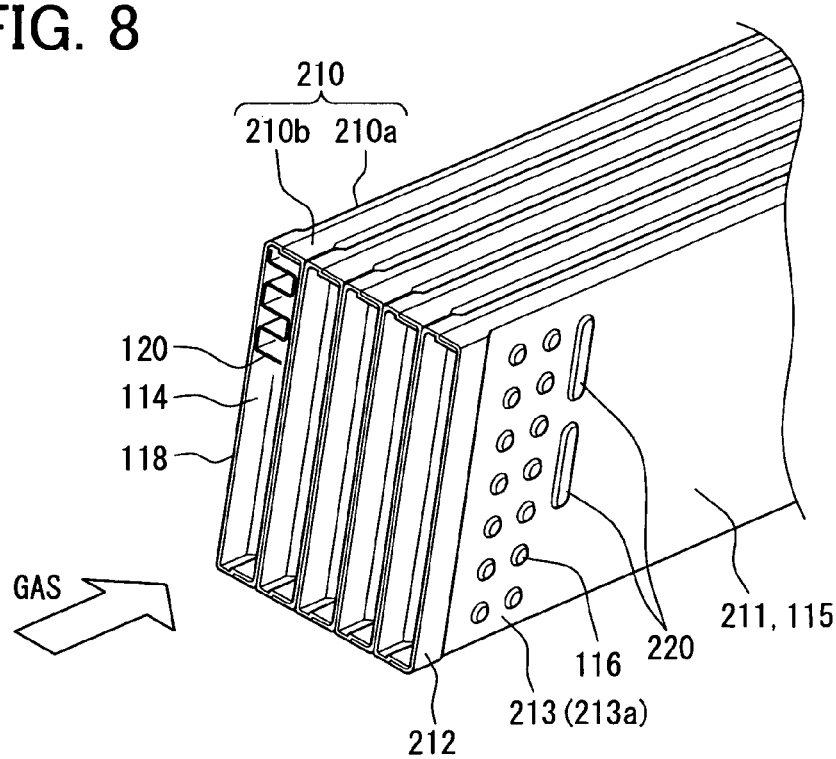
FIG. 8 is a schematic perspective view illustrating tubes of the gas cooler.

As shown in FIG. 8, the tube 210 is constructed of a first plate 210*a* and a second plate 210*b*, each of which has a shallow U-shape cross-section. Construction of the tube 210 is similar to that of the tube 110 of the first embodiment, thereby specific description is omitted. The tube base face 211 of the plate 210*a*, 210*b* has the projection part 212 and a recess part 213.

The projection part 212 is an embossed part protruding outward from the tube base face 211 due to a pressing work. The projection part 212 is located on the end portions in the longitudinal direction of the tube 210. The recess part 213 is recessed from the projection part 212 toward the tube base face 211. The tubes 210 are layered such that the projection parts 212 are contact with each other. A clearance formed between the recess parts 213 of the tubes 210 is defined to be a water passage 115.

As shown in FIG. 8, an inlet side opening 213*a* is defined between the recess parts 213 of the layered tubes 210 so as to oppose an expansion part 132*b*, 132*b*'. Cooling water flows through the inlet side opening 213*a*, such that the water passage 115 and outside communicates with each other through the inlet side opening 213*a*.

As shown in FIG. 7, an outlet side opening 213*b* is defined between the recess parts 213 of the layered tubes 210 so as to oppose the expansion part connected to the water outlet pipe 142. Cooling water flows out of the gas cooler 200 through the outlet side opening 213*b*, such that the water passage 115 and outside communicates with each other through the outlet side opening 213*b*. The inlet side opening 213*a* is located adjacent to an inlet side of exhaust gas of a gas passage 114 defined in the tube 210, and the outlet side opening 213*b* is located adjacent to an outlet side of exhaust gas of the gas passage 114 defined in the tube 210.

The projections 116 are arranged on the tube base face 211 of the tube 210 adjacent to the opening 213*a*. Two of the ribs 220 protruding from the tube base face 211 are formed on a downstream side of the projections 116 in the longitudinal direction of the tube 210. The rib 220 has an elongate oval shape extending in a width direction of the tube 210, and is located adjacent to the water inlet pipe 141 in the width direction of the tube 210. When the tubes 210 are layered, the rib 220 of the first plate 210*a* and the rib 220 of the second plate 210*b* oppose to each other. The rib 220 may be further formed on the water tank 130A, 130B, as shown in FIG. 7. The rib 220 of the water tank 130A, 130B may be located to contact the rib 220 of the tube 210.

The expansion parts 132*b* of the first water tank 130A are connected each other in the longitudinal direction of the tube 210 through a wall face 132*e*. Similarly the expansion parts 132*b*' of the second water tank 130B are connected each other.

Figure 9:
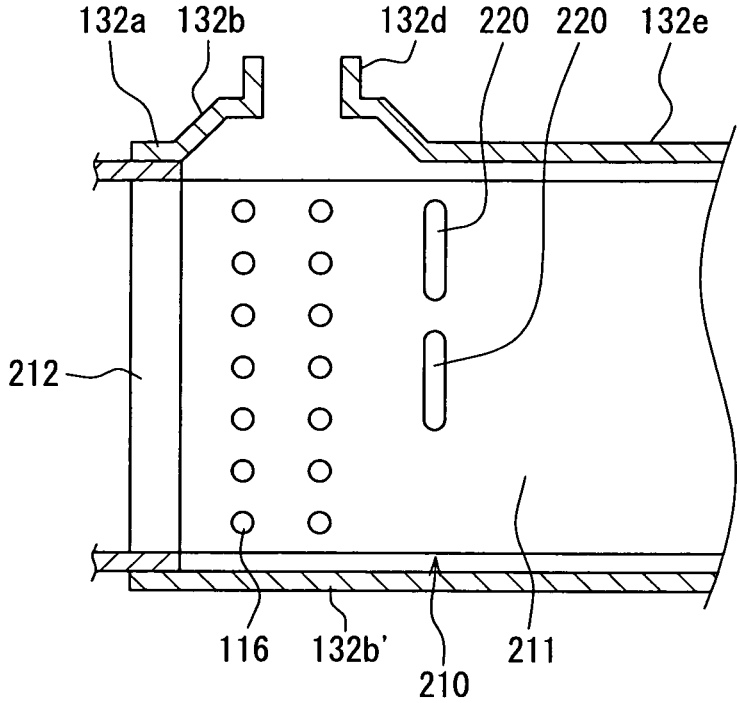
FIG. 9 is a schematic cross-sectional view illustrating the gas cooler.

As shown in FIG. 9, when the water inlet pipe 141 is connected to the pipe hole 132*d* located on a side face of the gas cooler 200, cooling water easily stagnates between the expansion part 132*b* of the first water tank 130A and an expansion part 132*b*' of the second water tank 130B. However, due to the oval ribs 220, cooling water flowing through the water inlet pipe 141 can be easily introduced toward the expansion part 132*b*' of the second water tank 130B from the expansion part 132*b* of the first water tank 130A. Thus, the stagnation of cooling water can be restricted.

Therefore, cooling water can smoothly flow in the inlet side of exhaust gas. Thus, a temperature of a thermal boundary layer of an outer surface of the tube 210 relative to cooling water can be decreased. Accordingly, local boiling of cooling water adjacent to the inlet side of exhaust gas can be restricted.

The expansion part 132*b*' of the second water tank 130B is flat in FIG. 9. Alternatively, the expansion part 132*b*' may protrude outward similar to the expansion part 132*b* of the first water tank 130A.

The rib 220 extends in the flowing direction of cooling water, and has a dimension of about two thirds of the width dimension of the tube 210 adjacent to the expansion part 132*b* of the first water tank 130A. The tube base face 211 located between the rib 220 and the expansion part 132*b*' in the width direction of the tube 210 is approximately flat. The rib 220 is located adjacent to the inlet side of exhaust gas.

Other Embodiment

The projections 116 are provided both end portions of the tube 110 in the longitudinal direction, such that the tube 110 is directionless in the longitudinal direction. However, the projections 116 may be provided only adjacent to the inlet side of exhaust gas.

The recess part 113 is provided on four corner portions of the tube 110. However, the recess part 113 may be provided only two corner portions corresponding to the inlet side opening 113*a* connected to the water inlet pipe 141 and the outlet side opening 113*b* connected to the water outlet pipe 142.

The tube 110, 210 is made of the first plate 110*a*, 210*a* and the second plate 110*b*, 210*b*. However, the tube 110, 210 may be made of a single tube material.

The heat exchanger is described as the gas cooler 100A, 100B, 200. However, the heat exchanger is not limited to the gas cooler 100A, 100B, 200. For example, the heat exchanger may be an exhaust gas recovering heat exchanger, which heats cooling water by exchanging heat between exhaust gas discharged outside and the cooling water.

The heat exchanger is made of stainless steel material. Alternatively, the heat exchanger may be made of aluminum base alloy, copper base alloy or so on based on a usage.

Such changes and modifications are to be understood as being within the scope of the present invention as defined by the appended claims.

What is claimed is:

1. A heat exchanger comprising:

a plurality of tubes layered with each other, each of the plurality of tubes having a flat cross-section;

a plurality of passages defined outside of the layered tubes, wherein heat is exchanged between exhaust gas of an internal combustion engine passing through the plurality of tubes and cooling water passing through the plurality of passages;

an inlet through which the cooling water flows into the plurality of passages in a direction perpendicular to a flow direction of the exhaust gas on an inlet side of the exhaust gas;

a plurality of projections disposed immediately adjacent the inlet of the exhaust gas;

a rib arranged immediately adjacent the plurality of projections between the plurality of projections and an outlet of the exhaust gas, the plurality of projections being the only projections between the rib and the inlet of the exhaust gas; wherein the rib having a width and a length, the length being greater than the width, the length of the rib extending only in the direction perpendicular to the flow direction of the exhaust gas; and a distance between the rib and the inlet side of the exhaust gas is smaller than a distance between the rib and the outlet of the exhaust gas.

* * * * *